United States Patent [19]

Lenger

[11] Patent Number: 4,856,127

[45] Date of Patent: Aug. 15, 1989

[54] EXPANDABLE HEADBOARD FOR BEDS

[75] Inventor: Sidney A. Lenger, Kernersville, N.C.

[73] Assignee: The Pilliod Cabinet Company, Swanton, Ohio

[21] Appl. No.: 214,197

[22] Filed: Jun. 27, 1988

[51] Int. Cl.[4] ..... A47C 19/04

[52] U.S. Cl. ..... 5/53 R; 5/183

[58] Field of Search ..... 5/53 R, 183, 280, 285

[56] References Cited

U.S. PATENT DOCUMENTS

| | | | |
|---|---|---|---|
| Re. 5,275 | 2/1873 | Caro | 5/183 |
| 490,201 | 1/1893 | Hofacker | 5/183 |
| 867,820 | 10/1907 | Hamilton | 5/183 |
| 1,394,512 | 10/1921 | Tamarin et al. | 5/183 |
| 2,528,871 | 11/1950 | Deuschle | 5/183 |

FOREIGN PATENT DOCUMENTS

| | | | |
|---|---|---|---|
| 1113284 | 3/1858 | France | 5/183 |
| 933061 | 7/1963 | United Kingdom | 5/53 R |

*Primary Examiner*—Gary L. Smith
*Assistant Examiner*—Michael F. Trettel
*Attorney, Agent, or Firm*—Marshall & Melhorn

[57] ABSTRACT

An expandable headboard for a bed includes a central panel and a pair of cooperating side panels which are secured in alternate position to accommodate varying sized spring and mattress assemblies.

3 Claims, 2 Drawing Sheets

EXPANDABLE HEADBOARD FOR BEDS

BACKGROUND OF THE INVENTION

This invention relates generally to furniture and more particularly to an expandable and easily assembled headboard for a bed to accommodate spring and mattress assemblies of varying widths.

It has been found that manufacturers of furniture and associated retail trade must necessarily produce and maintain inventory of headboards for beds of differing dimensions to accommodate the spring and mattress supporting framework for differing sizes.

It is an object of this invention to produce an expandable headboard arrangement for the accommodation of at least two different sized spring and mattress assemblies.

SUMMARY OF THE INVENTION

The present invention overcomes the problems and disadvantages of the conventional headboard configuration by producing an expandable headboard which is particularly suitable, although not limited, to accommodate two different spring and mattress assemblies, such as queen size and king size, for example.

The expandable headboard, the invention includes a central panel having adjustably mounted side panels. The central panel is typically provided with two sets of internally threaded inserts receiving suitably mounted externally threaded fasteners adapted to extend through the associated side panels. One set of inserts utilized to accommodate one size spring and mattress assembly while another set of insert is used to accommodate a different size spring and mattress is assembly. Spring and mattress supporting frame is typically fastened to the headboard to provide a secure and rigid overall assembly.

An object of the present invention is to produce a single headboard capable of selective adjustment to accommodate different sizes of spring and mattress assemblies.

An object of the present invention is provide a space saving headboard which may be assembled for use and unassembled for storage or transit.

BRIEF DESCRIPTION OF THE DRAWINGS

The above, as well as the other objectives and advantages of the invention, will become readily apparent to one skilled in the art by reading the following detailed description of the preferred embodiment of the invention when considered in the light of the accompanying drawings, in which.

DETAILED DESCRIPTION OF THE PREFERRED EMBODIMENT

Figure 1:
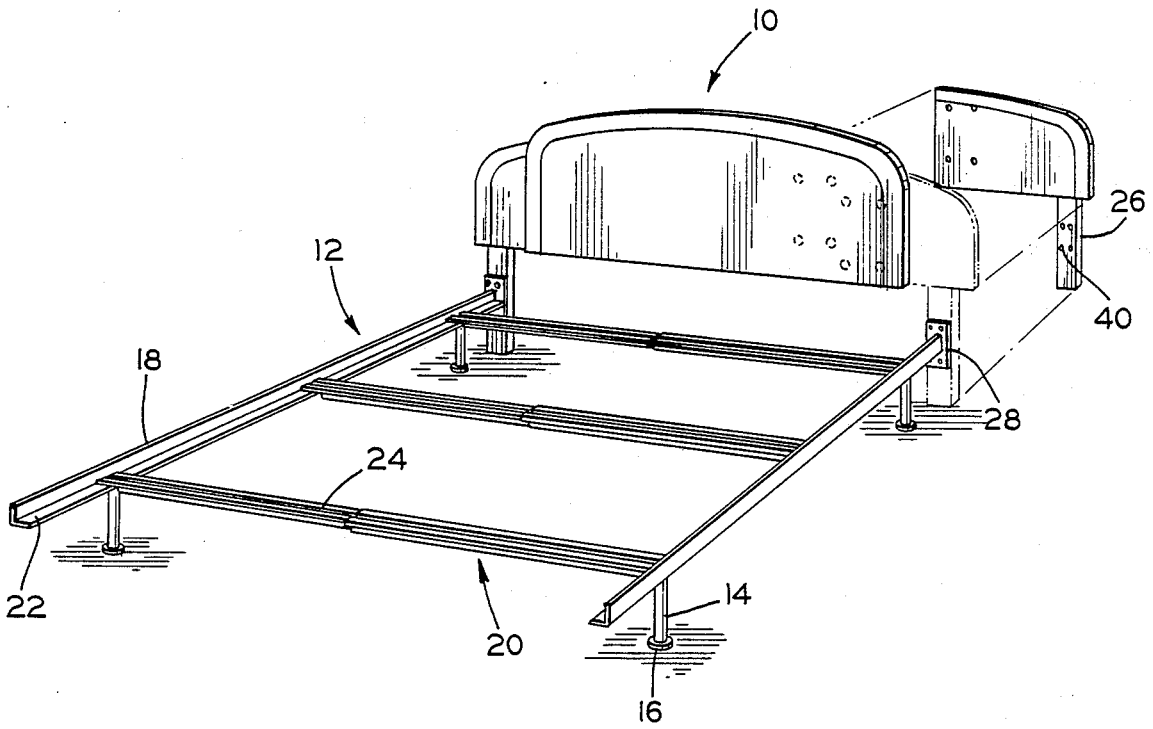
FIG. 1 is a perspective partially exploded view of an expandable headboard incorporating features of the present invention with a conventional spring and mattress supporting frame.

Referring to FIG. 1, there is illustrated an expandable headboard 10 embodying the features of the present invention which is mounted to a bed frame 12 having floor engaging legs 14 depending therefrom. The legs 14 include adjustable pad members 16 to stabilize the bed on an uneven surface.

The conventional frame 12 is formed of two angle side support rails 18 having cross braces 20, the opposite ends of which are supported on the ledge portion 22 of the respective side rail 18. The cross braces 20 may be comprised of two cooperating sections 24 adjustably fastened together in a telescoping manner as is well known in the art to provide for an adjustable width to the overall frame 12 from a queen size to a king size bed, for example. The side rails 18 are attached to legs 26 which depend downwardly from the headboard 10 and are secured thereto by a headboard mounting flange 28 on one end of each of the rails 18 and are secured by suitable threaded fastener means.

Figure 2:
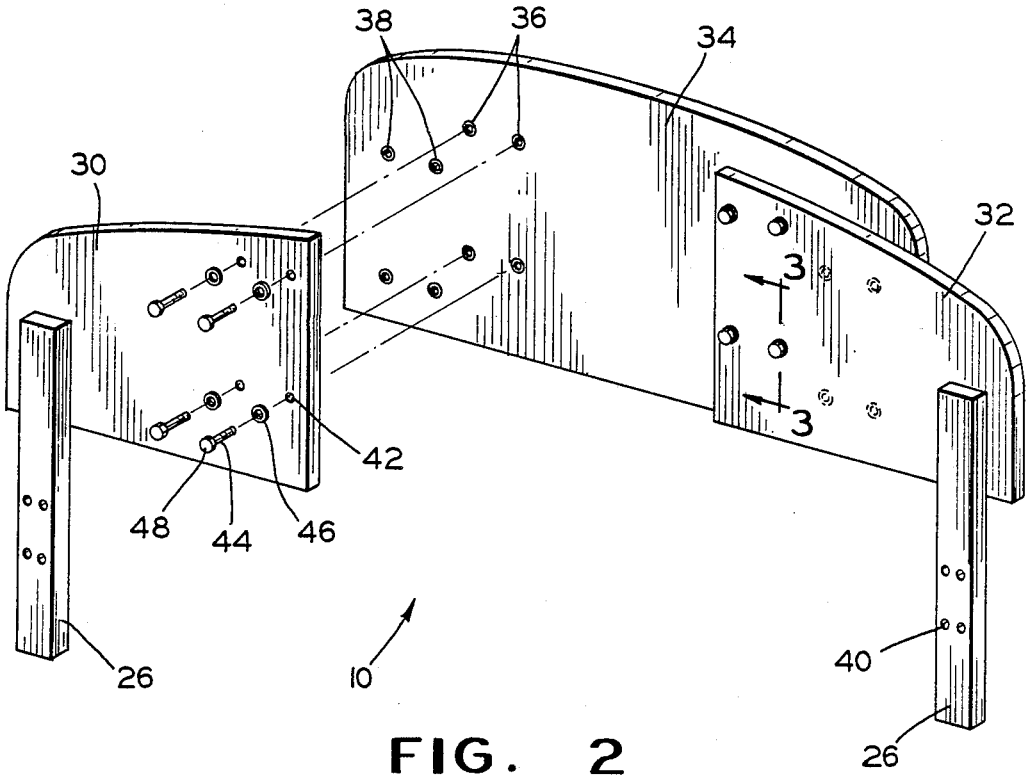
FIG. 2 is a rear elevational partially exploded view of the expandable headboard arrangement illustrated in FIG. 1.

As best illustrated in FIG. 2, the headboard 10 includes side panels 30 and 32 which are mounted to the rear surface of a central panel 34 by means of the threaded fasteners. Sets of internally threaded inserts 36 and 38 are disposed then suitably formed apertures in the central panel 34 at opposite sides thereof.

The side panels 30 and 32 are provided with apertures 42 which are spaced apart the same distance as the sets of inserts 36 and 38.

The upper portion of the legs 26 are secured to the rear surface of the panels 30 and 32 in any suitable manner. The legs 26 are provided with mounting apertures 40 for receiving threaded fasteners employed for mounting the flanges 28 on the ends of the respective side rails 18 in order to effect attachment of the frame 12 to the headboard assembly 10.

Figure 3:
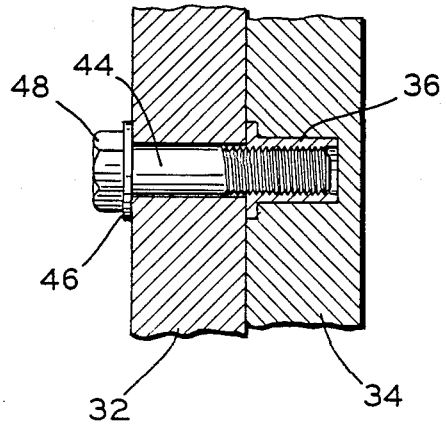
FIG. 3 is an enlarged fragmentary sectional view taken along line 3-3 of FIG. 2.

As shown in FIG. 3, when the side panel 32 is properly attached to the central panel 34; the threaded fasteners 44 and associated washer 46 are fully tightened and are effective to obtain an unitary structure. It would be appreciated that the aperture for receiving the internally threaded inserts 36 and 38 are of sufficient length to prevent the remote end of the threaded fasteners 44 to contact the innermost end of the aperture formed in the panel and thereby avoid breaking through the surface of the associated central panel 34. The washers 46 tend to distribute the pressure caused by the threaded fasteners 44 and prevent the heads 48 of the threaded fasteners 44 from penetrating the surface of the panels 30 and 32 when in secured position.

Figure 4:
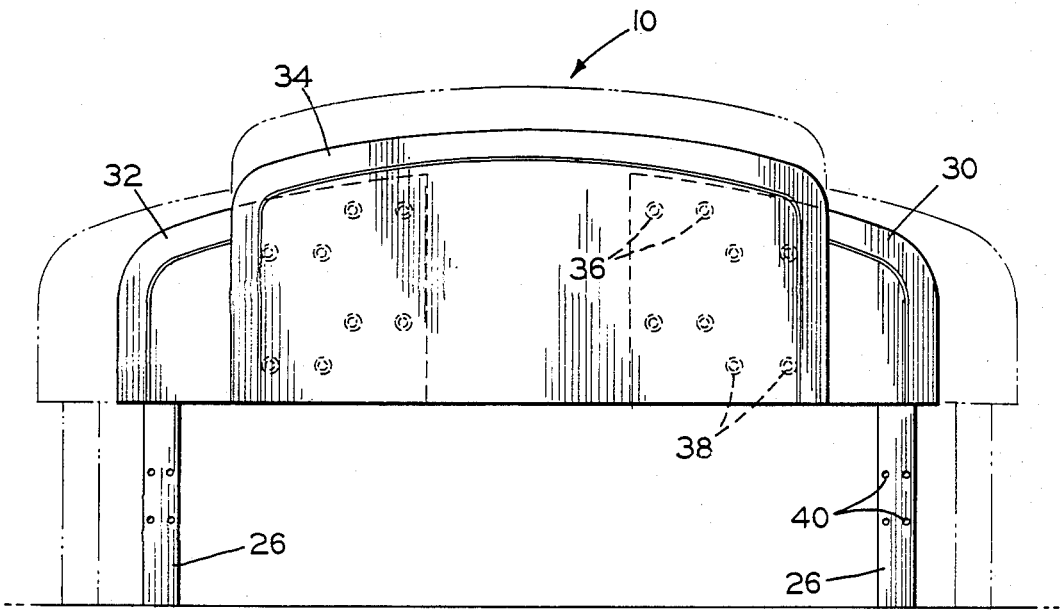
FIG. 4 is a front elevational view of the expandable headboard illustrating an expanded position of the headboard in dotted lines.

Referring to FIGS. 2 and 4, the threaded inserts 36 for the smaller size bed such as a queen size bed, for example, are disposed towards the center of the central panel 34 while the threaded insert 38 for the larger size bed such as a king size bed, for example, are disposed toward the outer marginal edges of the central panel 34.

When it is desired to cause the assembly to be expanded from the smaller size to a larger size, the panels 30 and 32 are disassembled by loosening and removing the threaded fasteners 44 from the associated inserts 36. The lengths of the cross braces 20 are then adjusted until the holes 42 of the side panels align with the inserts 38 allowing the threaded fasteners 44 to pass through the panels 30 and 32 and are received by the inserts 38 to effectively secure the panels 30 and 32 to the central panel 34 in the adjusted position.

It will be noted from an examination of FIGS. 1, 2, and 4 that the set of threaded inserts 38 is disposed at a lower elevation than the elevation of the set of threaded inserts 36. As a result, the relative position of the central panel and side panel 30 and 32 of the headboard assembly 10 in the assembled position shown in full line is such that the central panel 34 is elevated in respect to the side panel in the alternate position.

When it is desired to change the headboard assembly 10 to accommodate a smaller size spring and mattress assembly, the panels 30 and 32 are removed from the central panel 34 by removing the threaded fasteners 44. After the width of the frame 12 is adjusted to accommodate the different size spring and mattress assembly, the panels 30 and 32 are then positioned as to cause the set of apertures 42 to align with an adjacent set of internally threaded inserts. The threaded fasteners 44 are then positioned reinserted and tightened to affect the unitary headboard configuration.

It will be understood that an expendable headboard incorporating the features of the invention can be applied to any bed size, for example, twin, double, queen, king etc.

What is claimed is:

1. An expandable headboard for attachment to a mattress supporting frame including:

a central planar panel having spaced apart side portions;

a first array of fastener receiving means formed in the side portions of said central panel;

a pair of side panels;

a second array of fastener receiving means formed in said side panels for selective alignment with selected ones of said first array of fastener receiving means;

fasteners associated with said first array and said second array of fastener receiving means for attaching said side panels to respective side portions of said central panel; and means for respectively attaching said side panels to the mattress supporting frame.

2. The invention defined in claim 1 wherein said first array of threaded fasteners receiving means includes at least two sets of receiving means.

3. The invention defined in claim 1 wherein at least the first array of fastener receiving means is threaded.

* * * * *